US006410838B1

(12) United States Patent
Takeuchi

(10) Patent No.: US 6,410,838 B1
(45) Date of Patent: Jun. 25, 2002

(54) MUSICAL SOUND SIGNAL SYNTHESIZER AND METHOD FOR SYNTHESIZING MUSICAL SOUND SIGNALS USING NONLINEAR TRANSFORMER

(75) Inventor: Chifumi Takeuchi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/733,212

(22) Filed: Dec. 8, 2000

(30) Foreign Application Priority Data

Dec. 16, 1999 (JP) ..... 11-358030

(51) Int. Cl.[7] ..... G10H 7/12

(52) U.S. Cl. ..... 84/607; 84/661; 84/DIG. 9; 84/DIG. 10

(58) Field of Search ..... 84/604–607, 617, 84/655, 659–661, DIG. 9, DIG. 10

(56) References Cited

U.S. PATENT DOCUMENTS 3,743,755 A * 7/1973 Watson ..... 84/605
4,227,433 A * 10/1980 Chibana ..... 84/607
4,249,447 A 2/1981 Tomisawa
4,611,522 A * 9/1986 Suzuki ..... 84/607
4,612,838 A * 9/1986 Nagashima et al. ..... 84/607

* cited by examiner

*Primary Examiner*—Stanley J. Witkowski
(74) *Attorney, Agent, or Firm*—Morrison & Foerster LLP

(57) ABSTRACT

A musical sound signal synthesizer with a simple construction for synthesizing complex musical sound waveform signals including many harmonics in a peculiar form. A phase information generator 11 supplies phase information x with a sawtooth wave changing according to a phase of the musical sound to be generated via a calculator 12 to a sine wave table 13, from which output waveform information y is read out. The waveform information y is fed back to the calculator 12 via an absolute value transformer 14, a low pass filter 15 and a gain controller 16. The output waveform information y outputted from the sine table 13 is transformed nonlinearly, which is fed back to the phase information x, which makes a complex change. As a result thereof, the waveform, which is represented by waveform information outputted from the sine wave table 13, becomes peculiar for a musical sound signal synthesized by phase or frequency modulation technique.

20 Claims, 12 Drawing Sheets

MUSICAL SOUND SIGNAL SYNTHESIZER AND METHOD FOR SYNTHESIZING MUSICAL SOUND SIGNALS USING NONLINEAR TRANSFORMER

BACKGROUND OF THE INVENTION

1. Field of the Invention

The present invention relates to a musical sound signal synthesizer and a method for synthesizing musical sound signals, which synthesizer is used for various units generating a musical sound, such as an electronic musical instrument, a game apparatus, and a personal computer.

2. Description of the Related Art

In known such musical sound signal synthesizers, a modulation system, such as a phase modulation and a frequency modulation, has been employed to form harmonic components to synthesize musical sound signals.

In such synthesizers, to obtain full harmonic components, phase information is inputted in a sine wave table, which outputs waveform information representing a sine waveform, which information is fed back to the sine wave table as a piece of phase information.

With conventional synthesizers, however, peculiar waveforms signals representing waveforms such as square waves cannot be produced, so that various waveforms are not generated, while generating musical sound waveform signals which change from sine waveforms to sawtooth-like waveforms.

SUMMARY OF THE INVENTION

In view of the foregoing, it is an object of the present invention to provide a musical sound signal synthesizer with a simple construction, in which complex musical sound waveform signals including many harmonics can be synthesized.

To achieve the above-mentioned object, the musical sound signal synthesizer of the present invention comprises: a waveform generator generating waveform information representing a required waveform based on supplied phase information, a nonlinear transformer transforming nonlinearly the waveform information generated by the waveform generator, and a calculator calculating phase information corresponding to a phase of a musical sound signal to be generated and the waveform information nonlinearly transformed and supplying the calculated phase information to the waveform generator.

In this case the nonlinear transformer is constituted by a polarity transformer inputting information with a positive and a negative polarity and transforming the inputted information into information with one polarity.

According to the above-mentioned construction, the waveform information generated by the waveform generator is transformed nonlinearly by the nonlinear transformer, and the nonlinearly transformed waveform information and the phase information corresponding to the phase of the musical sound signal to be generated are calculated, so that the calculated information is fed back to the waveform generator.

As a result thereof, the phase information to be supplied to the waveform generator changes complexly, so that the waveform, which is represented by waveform information outputted from the waveform generator, becomes peculiar for a musical sound signal synthesized by modulation technique.

Also, the musical sound signal synthesizer of the present invention comprises: a waveform generator generating waveform information representing a required waveform based on supplied phase information, a nonlinear transformer transforming nonlinearly phase information to be supplied to the waveform generator, and a calculator calculating phase information corresponding to a phase of a musical sound signal to be generated and the nonlinearly transformed phase information and supplying the calculated phase information to the waveform generator.

In this case, the nonlinear transformer is constituted by, for example, polarity transformer inputting information with a positive and a negative polarity and transforming the inputted information into information with one polarity.

According to the above-mentioned construction, the phase information to be supplied to the waveform generator is transformed nonlinearly and the nonlinearly transformed phase information is fed back to the phase information corresponding to the phase of the musical signal to be generated.

As a result thereof, the phase information to be supplied to the waveform generator changes complexly, so that the waveform, which is represented by waveform information outputted from the waveform generator, becomes peculiar for a musical sound signal synthesized by modulation technique.

According to the above-mentioned inventions, the complex and peculiar musical sound waveform signals including many harmonics in a peculiar form can be synthesized with a simple construction, thereby meeting the demand of the user in that various waveforms can be generated.

BRIEF DESCRIPTION OF THE DRAWINGS

Other objects and advantages of the present invention will be readily understood by those skilled in the art from the following description of preferred embodiments of the present invention in conjunction with the accompanying drawings, wherein.

DETAILED DESCRIPTION OF THE PREFERRED EMBODIMENTS

First Embodiment

The first embodiment of the present invention will now be described with reference to the accompanying drawings.

Figure 1:
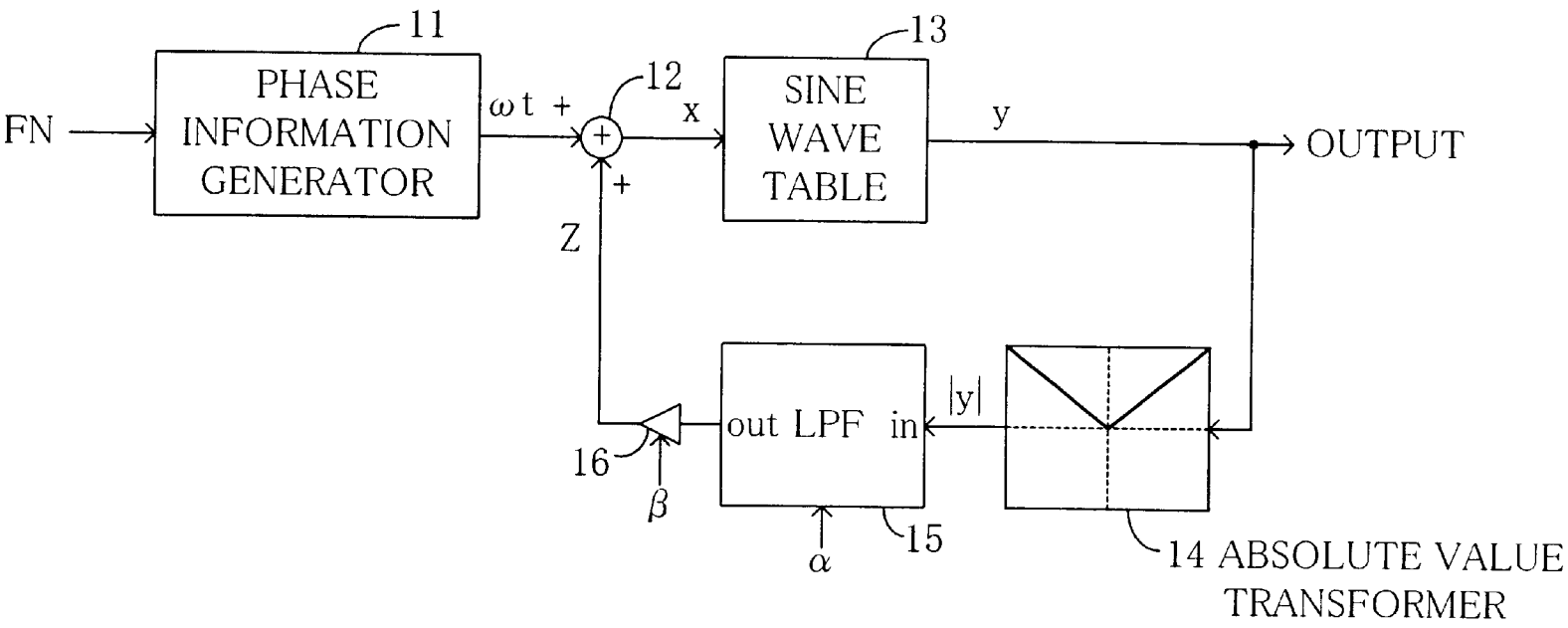
FIG. 1 is a block diagram illustrating the function of a musical sound signal synthesizer practiced as a first embodiment of the present invention.
Figure 2A:
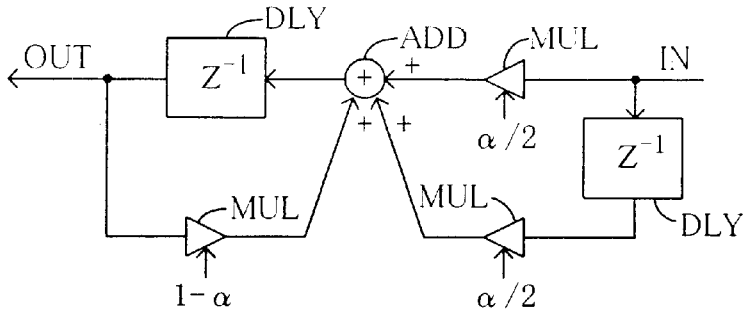
FIG. 2A–FIG. 2D are block diagrams illustrating sample circuits of low pass filters of FIG. 1.
Figure 2B:
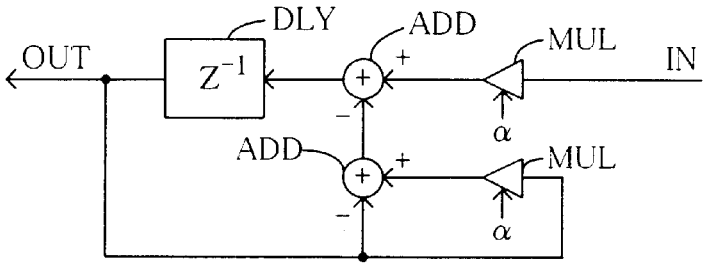
Figure 2C:
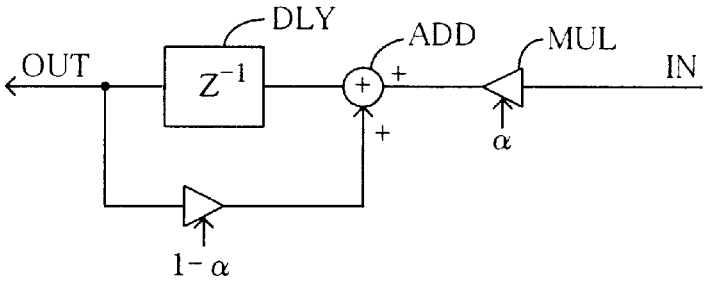
Figure 2D:
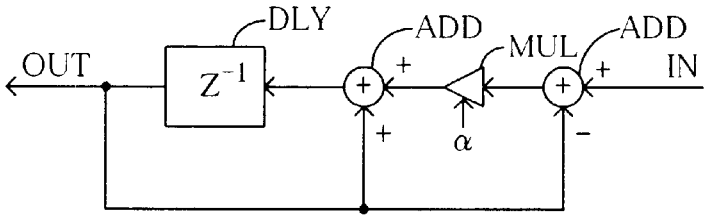

Referring first to FIG. 1, there is shown a block diagram of assistance in explaining the function of a musical sound signal synthesizer relating to the first embodiment.

The musical sound signal synthesizer comprises a phase information generator 11, a calculator 12 and a sine wave table 13. From the sine wave table 13 to the calculator 12 there is provided a feedback loop. In the feedback loop there are provided an absolute value transformer 14, a low pass filter 15, and a gain controller 16.

The phase information generator 11 inputs frequency information FN proportional to a pitch frequency of a musical sound to be generated, accumulates the inputted frequency information FN to transform the accumulated frequency information FN into phase information χt which changes consecutively from ⌈−1⌉ to ⌈+1⌉ in the form of a sawtooth-like wave, and outputs the phase information χt to the calculator 12.

The calculator 12 adds to the phase information χt feedback information z fed back via the absolute value transformer 14, the low pass filter 15, and the gain controller 16 from the sine wave table 13 to form address information x, and supplies the address information x to the sine wave table 13.

The sine wave table 13, which constitutes waveform generator, stores plural sampling values, which represents a sine waveform for one wave which changes from ⌈−1⌉ to ⌈+1⌉ with the center at ⌈0⌉. These sampling values are read out according to the address information x, and are outputted as output waveform information y to the absolute value transformer 14.

The absolute value transformer 14, which constitutes a nonlinear transformer, transforms the output waveform information y into the absolute value |y| by not switching a polarity with respect to a positive value of the output waveform information y and switching a polarity with respect to a negative value thereof and outputs the transformed value |y| to the low pass filter 15.

The low pass filter 15 eliminates high frequency components included in the transformed value |y| to stabilize the operation of the musical sound signal synthesizer. To the low pass filter 15 a controlling value α for controlling a filter characteristic (mainly a cut-off frequency) is supplied from an external unit to a control input terminal. The controlling value α can be varied into various values.

For the low pass filter 15, various known low pass filters can be utilized. For example, as shown in FIG. 2A–FIG. 2D, the low pass filter 15 can be composed of various combinations of a delay circuit DLY, an adder ADD and a multiplier MUL.

The delay circuit DLY delays input information by one bit. The adder ADD adds sets of input information. In FIG. 2A–FIG. 2D, a reference mark ⌈+⌉ designates adding and a reference mark ⌈−⌉ designates subtracting. The multiplier MUL multiplies input information by controlling values α/2, 1−α and α to be supplied to a control input terminal(as illustrated in FIG. 2A–FIG. 2D).

The low pass filter 15 outputs the resultant transformed value [y] to the gain controller 16.

The gain controller 16 multiplies the transformed value |y| filtered by the low pass filter 15 by a controlling value for controlling a feedback amount to form feedback information Z, and supplies the feedback information z to the calculator 12. The controlling value β, which is one of the parameters for determining a form of a waveform signal to be synthesized, can be varied into various values and is supplied from an external unit to a control input terminal.

Next, the operation of the musical sound signal synthesizer based on the first embodiment will be explained.

When the frequency information FN proportional to the pitch frequency of a musical sound to be generated is supplied to the phase information generator 11, the phase information generator 11 accumulates the frequency information FN, transforms the accumulated frequency information FN into the phase information ωt which changes consecutively from ⌈−1⌉ to ⌈+1⌉ in the form of a sawtooth-like wave and outputs the phase information χt to the one input of the calculator 12.

To the other input of the calculator 12 the feedback information z fed back from the sine wave table 13 is supplied.

The feedback information z is formed in accordance with following processing.

The waveform information y is read out from the sine wave table 13 and is transformed into the absolute value transformer 14 to become the transformed value |y|. The transformed value |y| is processed by the low pass filter 15. After the low pass filter processing, the transformed value |y| is multiplied by the control value β by the gain controller 16, so that the feedback information z is formed. The feedback information z and the phase information cot are added together to obtain the address information x. The address information x is supplied to the sine wave table 13, from which the waveform information y is read and outputted.

Figure 3A:
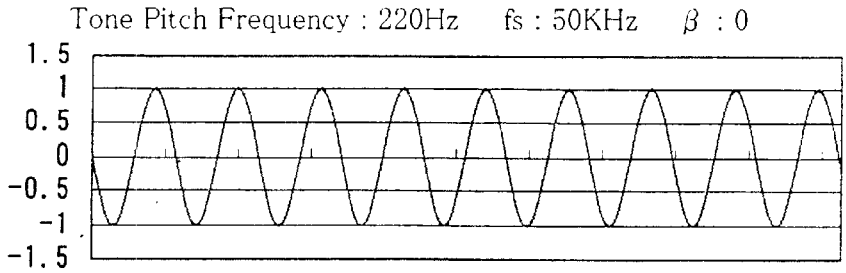
FIG. 3A–FIG. 3C are waveform diagrams, each of which illustrates a waveform signal outputted in case each controlling value $\beta$ is set to a different value in the first embodiment.
Figure 3B:
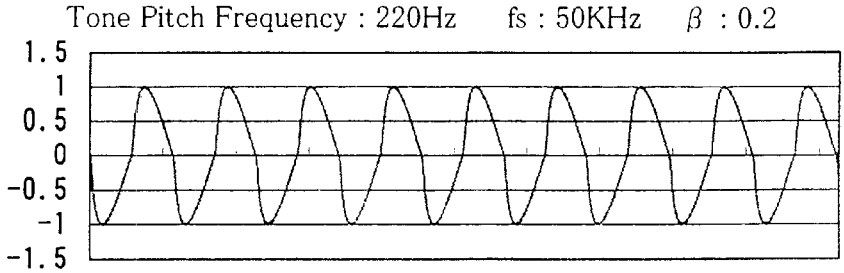
Figure 3C:
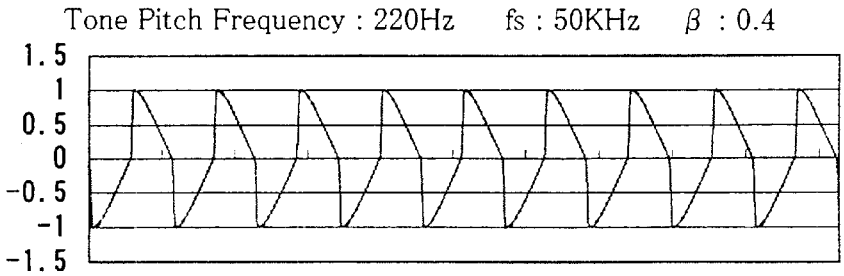

Referring now to FIG. 3A–FIG. 3C, there are shown waveform charts, which give results of calculation samples of the musical sound waveform signals represented by the output waveform information y without using the low pass filter 15.

In these calculation samples, the controlling values β are set to ⌈0⌉, ⌈0.2⌉, and ⌈0.4⌉, while the tone pitch frequency is set to 220 Hz and the sampling frequency fs is set to 50 KHz.

From FIG. 3A–FIG. 3C, it is obvious that a larger control value β or a larger feedback gain to increase the feedback information z causes a musical sound waveform signal to become peculiar for a musical sound signal synthesized by modulation technique, such as a square wave.

According to the first embodiment, the output waveform information y generated by the sine wave table 13 is transformed into the absolute value by the absolute value transformer 14.

That is, the output waveform information y with a positive and a negative polarity is transformed into the information with one polarity to become the transformed value |y|.

In other words, the output waveform information y is transformed nonlinearly. The transformed value |y| is supplied via the low pass filter 15 to the gain controller 16, which multiplies the transformed value |y| by the controlling value β to generate the feedback information z.

The feedback information z is supplied to the calculator 12. The calculator 12 adds the feedback information z to the phase information ωt outputted from the phase information generator 11 to form the address information x, which makes a complex change. The address information x is supplied to the sine wave table 13.

As a result thereof, the sine table 13 generates the output waveform information y representing a peculiar waveform for a musical sound signal synthesized by modulation technique, such as a square wave.

Next, a modified embodiment of the first embodiment will be described with reference to FIG. 4.

Figure 4:
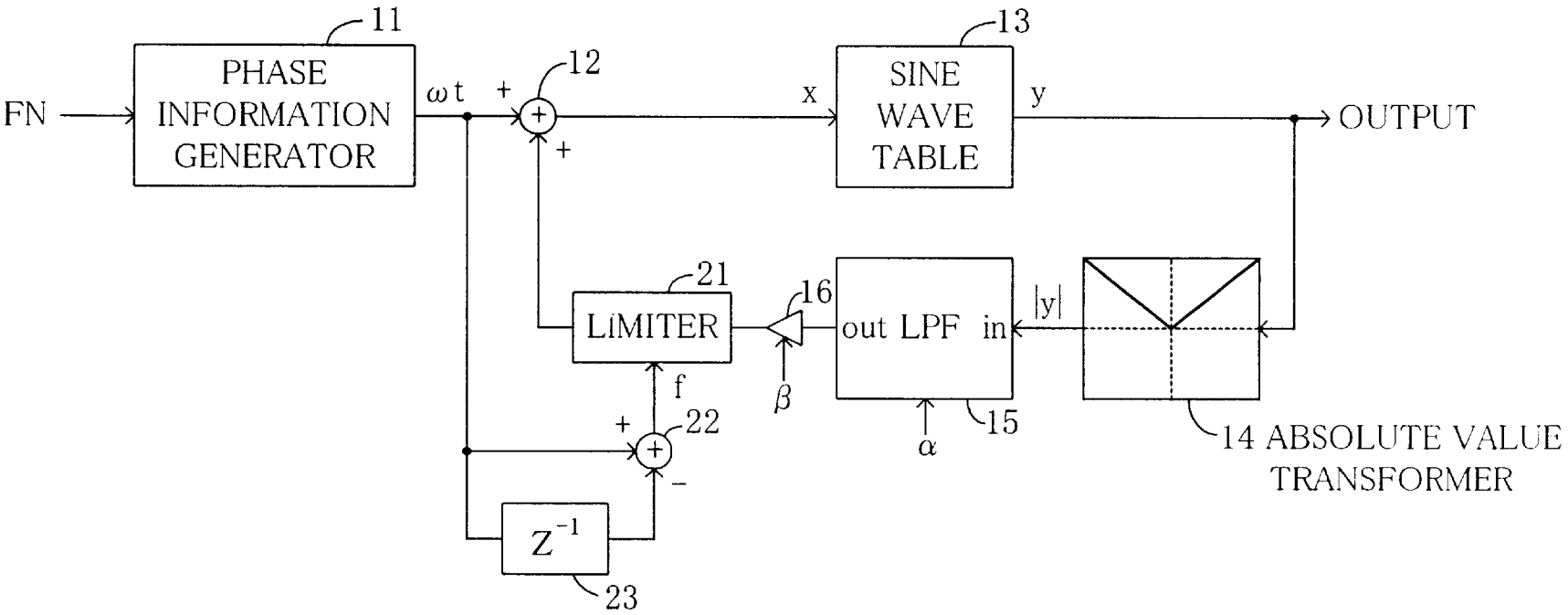
FIG. 4 is a block diagram for illustrating the function of the musical sound signal synthesizer as practiced in a modified embodiment of the first embodiment.

FIG. 4 is a block diagram of assistance in explaining the function of the musical sound signal synthesizer relating to the modified embodiment of the first embodiment.

In the modified embodiment there is provided a limiter 21 between the gain controller 16 and the calculator 12 practiced in the first embodiment.

The limiter 21 is provided with a control input terminal f, to which the calculator 22 is connected. To the calculator 22 a delay unit 23 is connected.

The phase information generator 11 outputs the phase information ωt to the calculator 22 and the delay unit 23.

The delay unit 23 delays the phase information ωt by one bit and outputs the delayed phase information ωt to the calculator 22.

The calculator 22 subtracts the delayed phase information ωt from the phase information ωt outputted from the phase information generator 11 and supplies the subtracted phase information ωt to the control input terminal f of the limiter 21.

Figure 5:
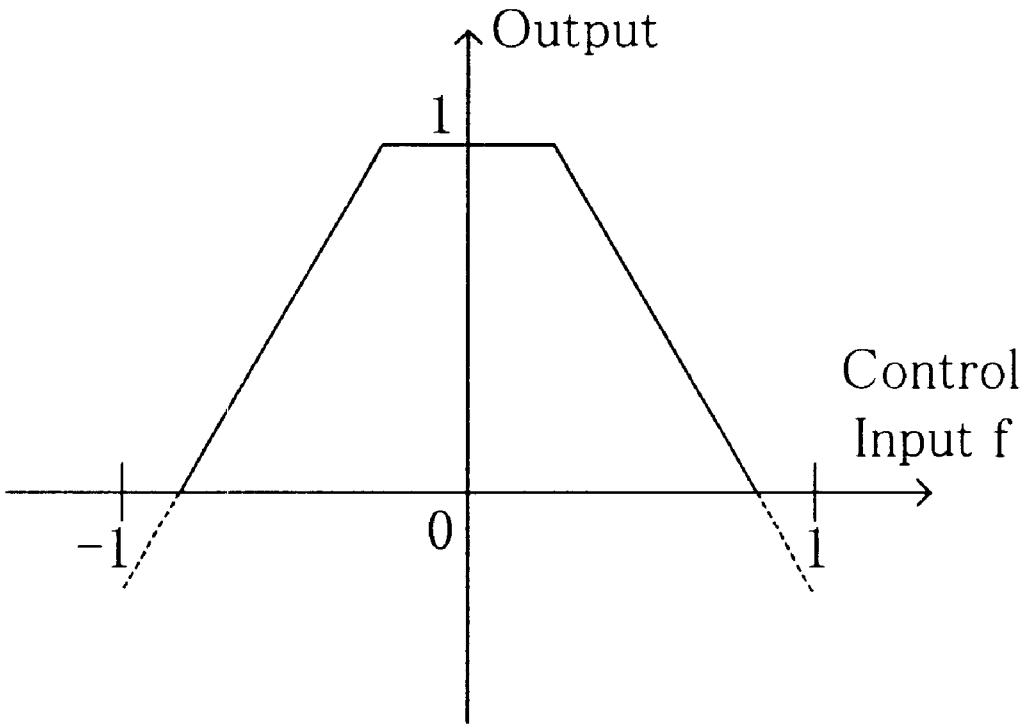
FIG. 5 is a graph illustrating a characteristic of the limiter illustrated in FIG. 4.

The limiter 21 limits values of the feedback information z supplied from the gain controller 16 to a characteristic as shown in FIG. 5 based on values of the subtracted phase information ωt supplied to the control input terminal f of the limiter 21. The limiter 21 outputs the resultant feedback information z to the calculator 12. In the modified embodiment the calculator 22 differentiates the phase information ωt (calculates a slope of a waveform represented by the phase information ωt) to find a controlling value proportional to the tone pitch frequency of the musical sound signal to be generated.

Accordingly, as tone pitch frequency of the musical sound signal to be generated becomes higher, a maximum value of the feedback information z is reduced.

As a result thereof, a high frequency component is not fed back to the phase information ωt, thereby preventing a folded (inverted) noise generation due to the feedback of the high frequency components.

In the modified embodiment the calculator 22 and the delay unit 23 may be eliminated.

In this case the frequency information FN to be inputted in the phase information generator 11 may be supplied to the control input terminal f of the limiter 21, which limits a maximum value of the feedback information z based on the frequency information FN.

In this case, the characteristic graph of FIG. 5 obtained based on the frequency information FN should be changed from that obtained in cases where the calculator 22 and the delay unit 23 are used.

Second Embodiment

The second embodiment of the present invention will now be described with reference to FIG. 6.

Figure 6:
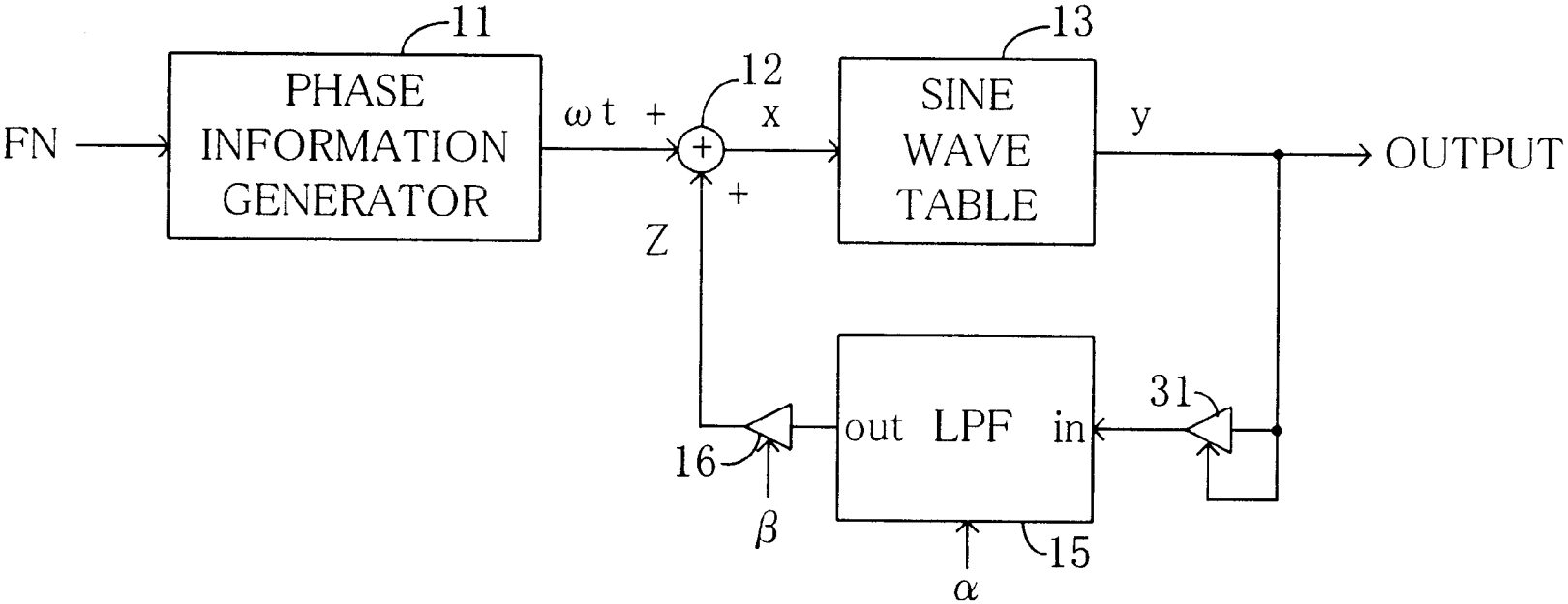
FIG. 6 is a block diagram illustrating a musical sound signal synthesizer as practiced in the second embodiment of the present invention.

FIG. 6 is a block diagram of assistance in explaining the function of the musical sound signal synthesizer relating to the second embodiment.

In the musical sound signal synthesizer of the second embodiment the absolute value transformer 14, which constitutes the nonlinear transformer of the first embodiment, is replaced by a calculator 31.

The calculator 31 squares the output waveform information y read out from the sine wave table 13.

According to this construction, the output waveform information y is transformed nonlinearly (the output waveform information y with a positive and a negative polarity is transformed into the information with one polarity) to form the feedback information z. The feedback information z is supplied via the low pass filter 15 and the gain controller 16 to the calculator 12, which adds the feedback information z to the phase information ωt.

As a result thereof, such a peculiar musical sound waveform signal as that of the first embodiment can be generated.

Figure 7A:
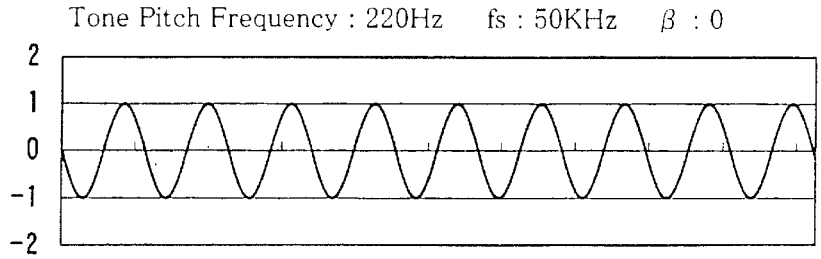
FIG. 7A–FIG. 7C are waveform diagrams, each of which illustrates a waveform signal outputted in case each controlling value $\beta$ is set to a different value in the second embodiment.
Figure 7B:
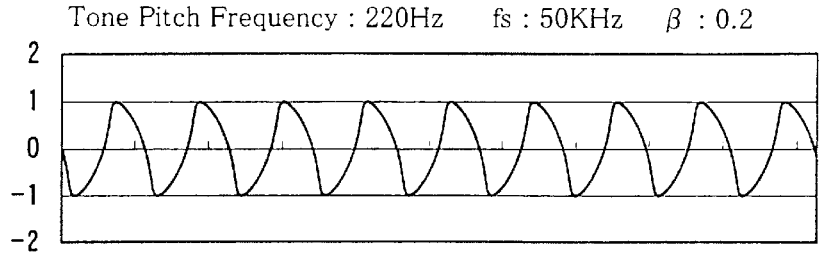
Figure 7C:
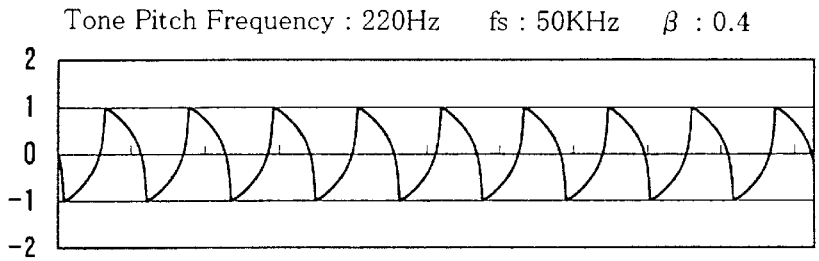

Referring now to FIG. 7A–FIG. 7C, there are shown waveform charts, which give results of calculation samples of the musical sound waveform signals represented by the output waveform information y without using the low pass filter 15 in the second embodiment.

In these calculation samples, as practiced in the first embodiment, the controlling values β are set to [0.], [0.2], and [0.4], while the tone pitch frequency is set to 220 Hz and the sampling frequency fs is set to 50 KHz.

From FIG. 7A–FIG. 7C it is obvious that a larger controlling value β or a larger feedback gain to increase the feedback information z causes a musical sound waveform signal to become peculiar like a square wave.

In the second embodiment, as practiced in the first embodiment, as shown in FIG. 4, the limiter 21 may be provided between the gain controller 16 and the calculator 12 to limit a maximum value of the feedback information z based on the tone pitch frequency of the musical sound to be generated.

Third Embodiment

Figure 8:
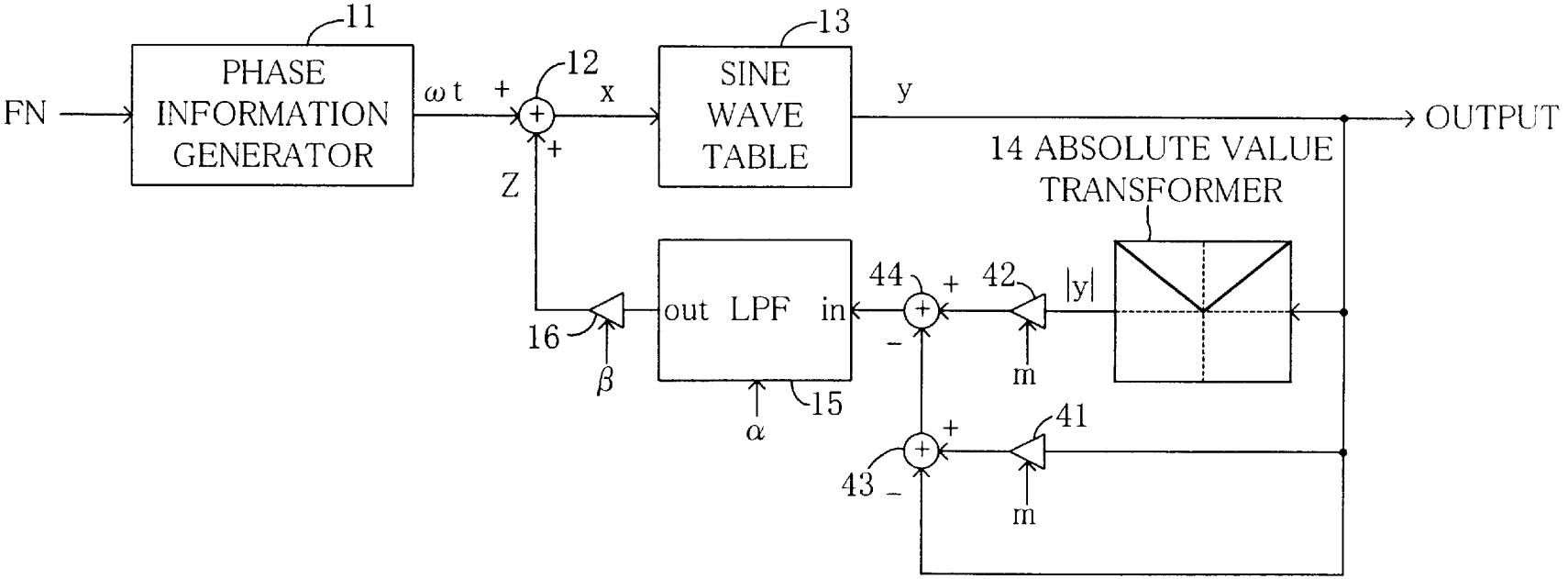
FIG. 8 is a block diagram for illustrating the function of a musical sound signal synthesizer as practiced in the third embodiment of the present invention.

Referring now to FIG. 8, there is shown a block diagram of assistance in explaining the function of the musical sound signal synthesizer relating to the third embodiment.

In the musical sound signal synthesizer of the third embodiment there are provided calculators 41 to 44 besides the constitution of the first embodiment.

The calculator 41 multiplies by a controlling value m the output waveform information y read out from the sine waveform table 13 and outputs the resultant value to the calculator 43.

The calculator 42 multiplies by the controlling value m the transformed value |y| transformed by the absolute value transformer 14 and outputs the resultant value to the calculator 44. The controlling value m, like the controlling value β, is one of the parameters for determining a form of a waveform signal to be synthesized. The controlling value m, which is varied into various values, is supplied from an external unit.

The calculator 43 subtracts the waveform information y read out from the sine wave table 13 from the value outputted from the calculator 41 and outputs the resultant value to the calculator 44.

The calculator 44 subtracts the value outputted from the calculator 43 from the value outputted from the calculator 42 and supplies the resultant value to the low pass filter 15.

In the third embodiment the output waveform information y is transformed nonlinearly to become the feedback information z, which is supplied to the calculator 12. The calculator 12 adds the feedback information z to the phase information ωt.

As a result thereof, the musical sound waveform which is peculiar like a square wave is generated, as practiced in the first embodiment.

According to the third embodiment, the transformed value |y| and the output waveform information y are weighted respectively by the controlling value m to be varied into various values and are supplied to the low pass filter 15.

As a result thereof, compared to the output waveform information y generated in the first embodiment, more various output waveform information y can be generated.

Figure 9A:
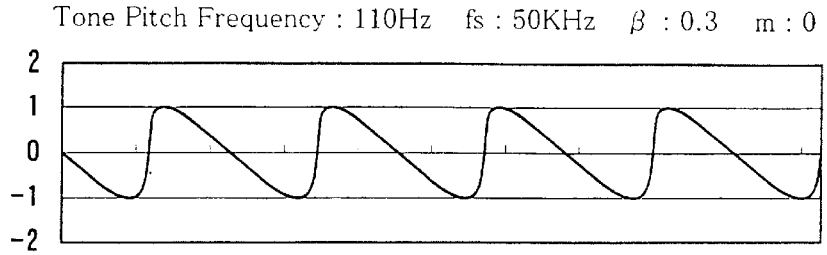
FIG. 9A–FIG. 9C are waveform diagrams, each of which illustrates a waveform signal outputted in case each controlling value m is set to a different value in the third embodiment.
Figure 9B:
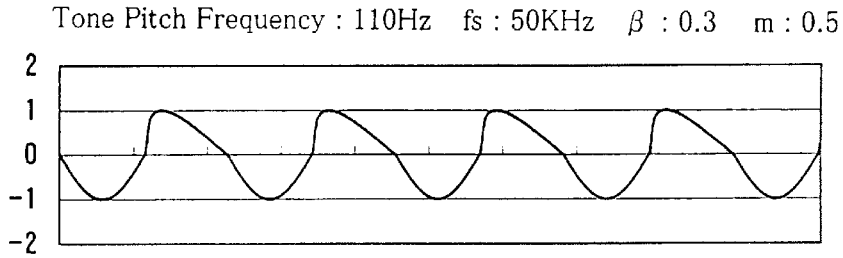
Figure 9C:
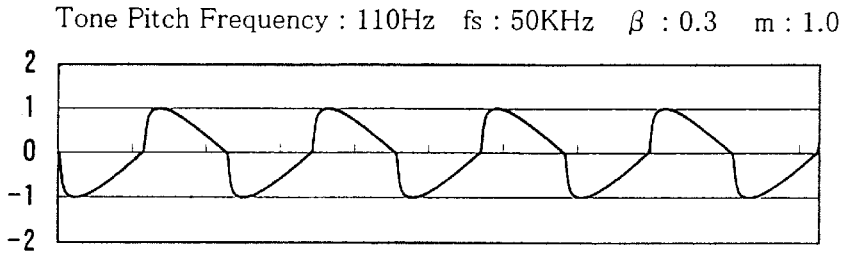

Referring now to FIG. 9A–FIG. 9C, there are shown waveform charts, which give results of calculation samples of the musical sound waveform signals represented by the output waveform information y without using the low pass filter 15 in the third embodiment.

In these calculation samples, the controlling value β is fixed to ⌈0.3⌉ and the controlling values m are set to ⌈0⌉, ⌈0.5⌉, ⌈1.0⌉, while the tone pitch frequency is set to 110 Hz and the sampling frequency fs is set to 50 KHz.

From FIG. 9A–FIG. 9C it is obvious that a larger control value m causes a musical sound waveform signal to become peculiar like a square wave.

In the third embodiment, as practiced in the first embodiment, as shown in FIG. 4, the limiter 21 may be provided between the gain controller 16 and the calculator 12 to limit a maximum value of the feedback information z based on the tone pitch frequency of the musical sound to be generated. Furthermore, the absolute value transformer 14 may be replaced by the calculator 31 of the second embodiment.

Fourth Embodiment

The fourth embodiment of the present invention will be described with reference to FIG. 10.

Figure 10:
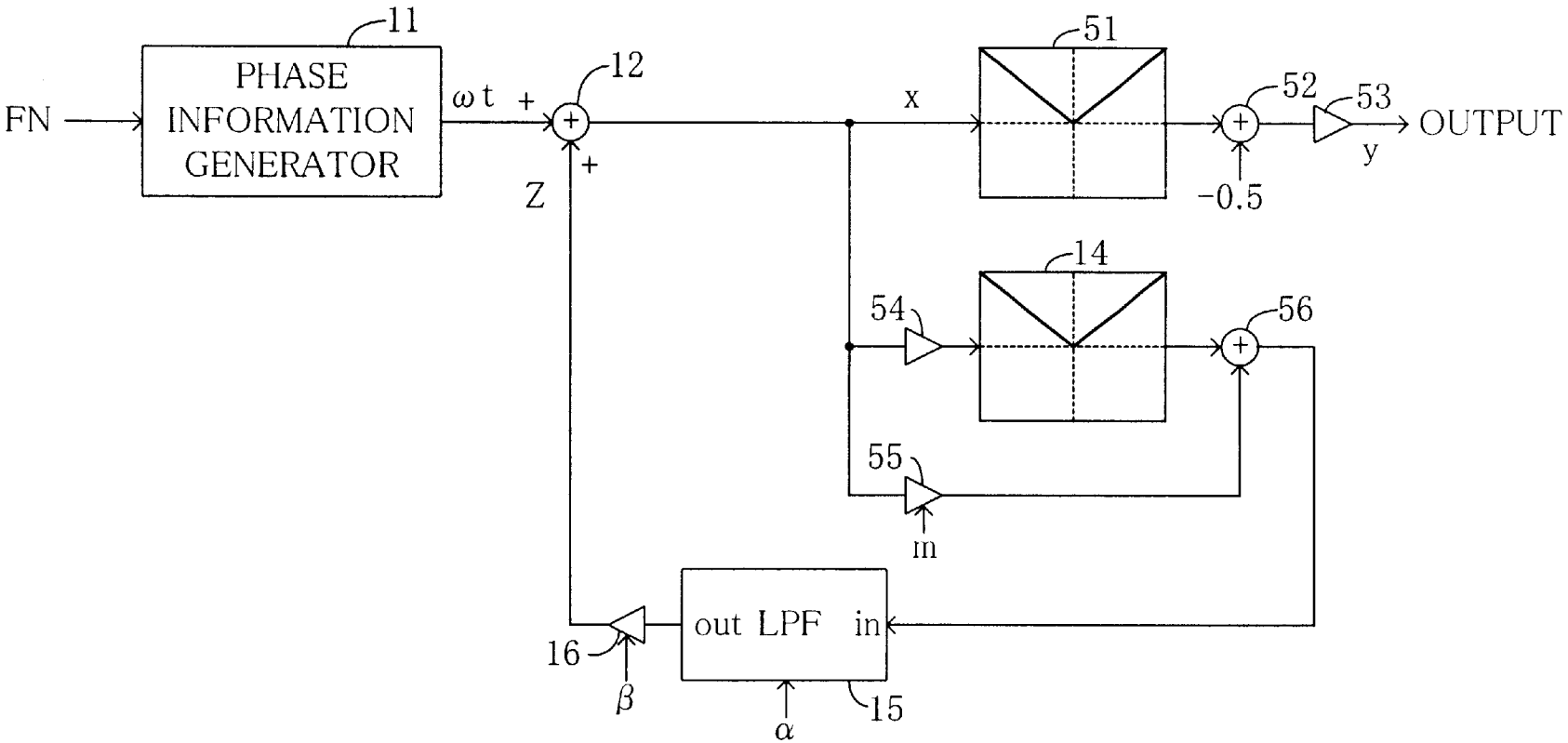
FIG. 10 is a block diagram for illustrating the function of a musical sound signal synthesizer as practiced in the fourth embodiment of the present invention.

FIG. 10 is a block diagram of assistance in explaining the function of the musical sound signal synthesizer relating to the fourth embodiment.

The musical sound signal synthesizer comprises the phase information generator 11, the calculator 12, an absolute value transformer 51, and calculators 52 and 53.

The phase information generator 11 and the calculator 12 have the same construction as those of the first embodiment.

The absolute value transformer 51 is connected to an output of the calculator 12. The absolute value transformer 51, which has the same construction as the absolute value transformer 14 of the first embodiment, corresponds to the waveform generator of the present invention.

Unlike the sine wave table 13 which constitutes the waveform generator in the first embodiment, the absolute value transformer 51 stores plural sampling values representing a triangle waveform for one wave if the address information x changes from ⌈+1⌉ to ⌈−1⌉ with the center at ⌈0⌉.

The calculator 52 adds to a value outputted from the absolute value transformer 51 a predetermined value (for example −0.5) to transform the resultant value into a signal to change into a positive and a negative value with the center at ⌈0⌉ and outputs the resultant signal value to the calculator 53.

The calculator 53 multiplies by ⌈2⌉ the signal value supplied from the calculator 52 or shifts the signal value to an upper side by one bit and discards the most significant bit(MSB).

Furthermore, in the fourth embodiment, there are provided calculators 54 to 56 besides the absolute value transformer 14, the low pass filter 15 and the gain controller 16 which are provided in the first embodiment.

Via the calculators 54 to 56, the absolute value transformer 14, the low pass filter 15 and the gain controller 16, a signal value to be supplied as the phase information x to the absolute value transformer 51 is adapted to be fed back to the calculator 12.

The calculator 54 multiplies by ⌈2⌉ a signal value of the phase information x supplied from the calculator 12 or shifts the signal value to an upper side by one bit, discards the MSB and outputs the resultant signal value to the absolute value transformer 14.

The calculator 55 multiplies by the controlling value m a signal value of the phase information x supplied from the calculator 12 and outputs the resultant signal value to the calculator56. The controlling value m is one of the parameters for determining a form of a waveform signal to be synthesized, which changes from ⌈−1⌉ to ⌈0⌉. The controlling value m, which is varied into various values, is supplied from an external unit.

The calculator 56 adds together a signal value outputted from the absolute value transformer 14 and a signal value outputted from the calculator 55 and outputs the resultant signal value to the low pass filter 15.

Via the low pass filter 15 and the gain controller 16 the feedback information z is formed and is fed back to the calculator 12, which supplies the phase information x to the absolute value transformer 51.

Next, the operation of the musical sound signal synthesizer according to the fourth embodiment will be described.

When the frequency information FN proportional to the pitch frequency of a musical sound to be generated is supplied to the phase information generator 11, the phase information generator 11 accumulates the frequency information FN, transforms the accumulated frequency information FN into the phase information ωt which changes consecutively from ⌈−1⌉ to ⌈+1⌉ in the form of a sawtooth-like wave and outputs the phase information ωt to the one input of the calculator 12.

The output signal from the calculator 12, which is supplied as the phase information x to the absolute value transformer 51, is transformed nonlinearly into the feedback information z by the calculators 54 and 55, the absolute value transformer 14, and the calculator 56, the low pass filter 15, and the gain controller 16 to be supplied to the other input of the calculator 12.

The above-identified nonlinear transformation performed by the calculators 54 to 56 and the absolute value transformer 14 will now be explained.

Figure 11A:
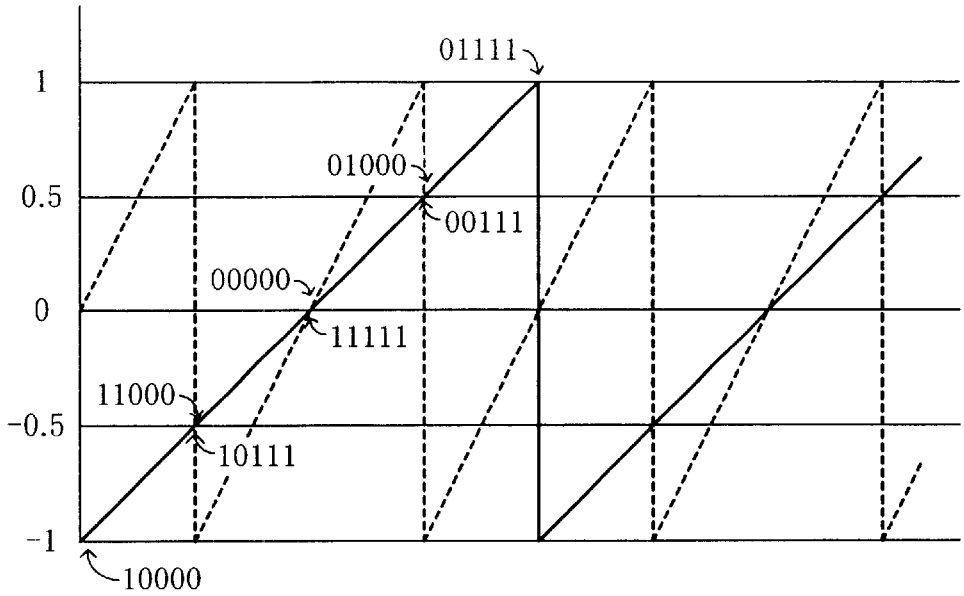
FIG. 11A–FIG. 11B are waveform diagrams for explaining a waveform of a respective part in the block diagram of FIG. 10.

When a sawtooth-like wave signal (an original signal) which changes consecutively from ⌈−1.0⌉ to ⌈+1.0⌉ as shown with a solid line in FIG. 11A (in fact, a more complex signal than a sawtooth-like wave signal due to the feedback processing) is outputted from the calculator 12 to the calculator 54, the calculator 54 performs a bit-shift calculation for the sawtooth-like wave signal to form a sawtooth-like wave signal with double the frequency of the original signal, which changes consecutively from ⌈−1.0⌉ to ⌈1.0⌉, as shown with a broken line in FIG. 11A.

Figure 11B:
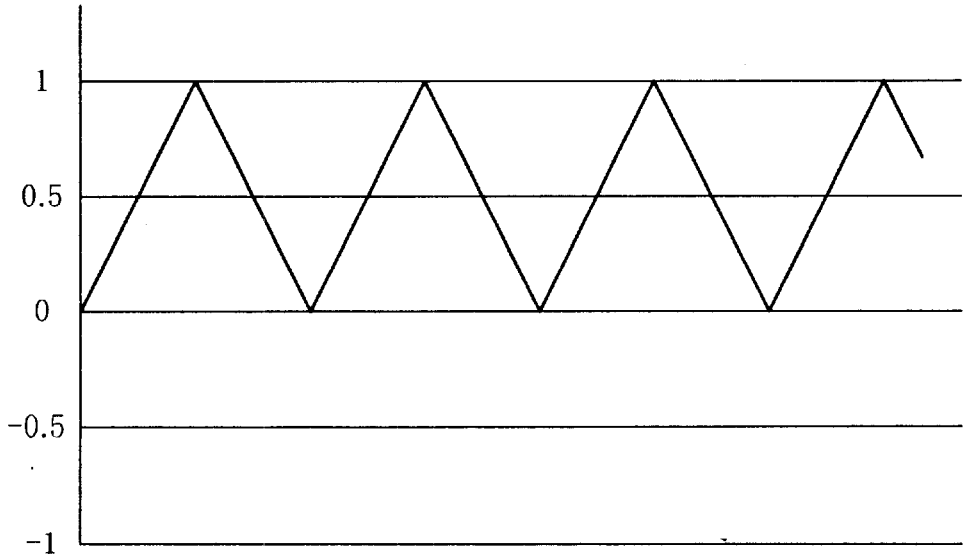
Figure 12A:
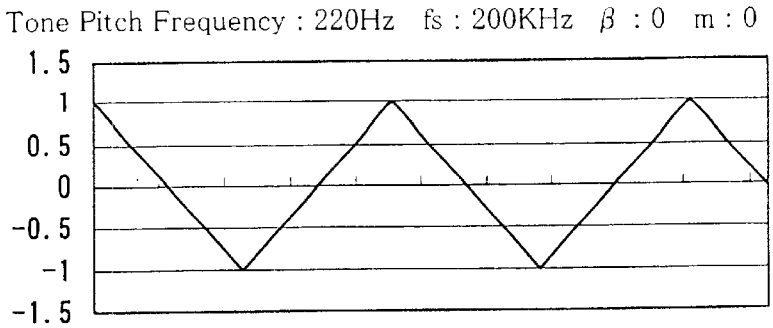
FIG. 12A–FIG. 12D are waveform diagrams, each of which illustrates a waveform signal outputted in case the controlling value β and the controlling value m are set to different values, respectively, in the fourth embodiment.
Figure 12B:
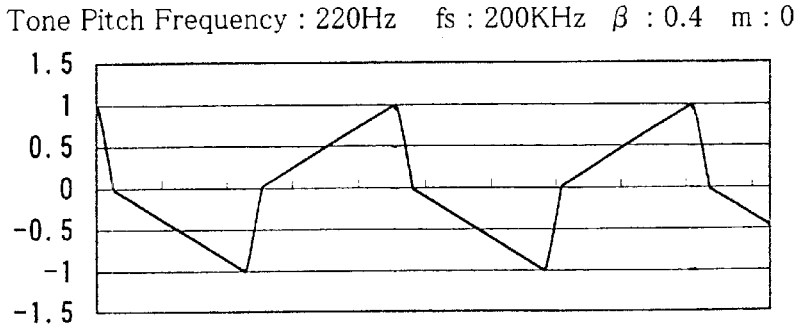
Figure 12C:
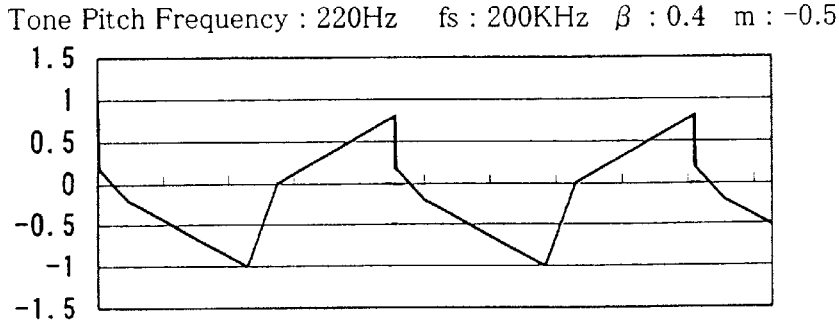
Figure 12D:
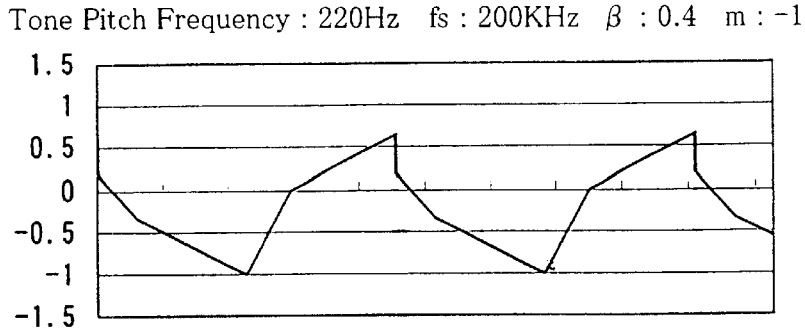

The sawtooth-like wave signal with double the frequency of the original signal is transformed into the absolute value by the absolute value transformer 14, which outputs a triangle wave signal with double the frequency of the original signal, as shown in FIG. 11B. To the triangle wave signal the waveform signal outputted via the calculator 55 from the calculator 12 is added by the calculator 56 at a ratio corresponding to the controlling value m.

The waveform signal obtained by the calculator 56 is fed back to the calculator 12 via the low pass filter 15 and the gain controller 16.

As a result thereof, the waveform signal which makes a complex change is supplied as the phase information x from the calculator 12 to the absolute value transformer 51. In FIG. 11 A each value designates a positive and a negative value numerically with a unit of five bit for the sake of convenience.

The absolute value transformer 51 transforms into the absolute value the phase information x which makes a complex change to obtain a transformed signal, which is supplied to the calculator 52.

The calculator 52 transforms the signal supplied from the absolute value transformer 51 into the signal which changes into a positive and a negative value with the center at [0], which signal is supplied to the calculator 53, which performs a bit-shift calculation to generate the waveform information y.

Referring now to FIG. 12A–FIG. 12D, there are shown waveform charts, which give results of calculation samples of the musical sound waveform signals represented by the output waveform information y without using the low pass filter 15.

In these calculation samples, the controlling value β and the controlling value m are set to [0,0], [0.4,0], [0.4, −0.5] and [0.4, −1], respectively, while the tone pitch frequency is set to 220 Hz and the sampling frequency fs is set to 50 KHz. From FIG. 12A–FIG. 12D it is obvious that a larger controlling value β or a larger feedback gain to increase the feedback information z causes a musical sound waveform signal to become peculiar like a square wave.

Also, a change in the controlling value m from [0] to a positive and a negative value results in the output waveform information y which is peculiar and similar to a square, the output waveform information y which makes a non-symmetrical change.

In the fourth embodiment, the phase information x to be supplied to the absolute value transformer 51, which constitutes the waveform generator, is supplied to the absolute value transformer 14, which transforms the phase information x into the absolute value (transforms the phase information nonlinearly) or transforms the phase information x with a positive and a negative polarity into the phase information with one polarity.

Further, via the low pass filter 15 and the gain controller 16 the feedback information z is formed and is supplied to the calculator 12, which adds the feedback information z to the phase information ωt generated by the phase information generator 11.

According to this construction, a change in the phase information x can result in the output waveform information y which is peculiar and similar to a square wave.

In the fourth embodiment, as practiced in the first embodiment, as shown in FIG. 4, the limiter 21 may be provided between the gain controller 16 and the calculator 12 to limit a maximum value of the feedback information z based on the phase frequency of the musical sound to be generated.

Furthermore, in the fourth embodiment, the absolute value transformer 14 may be replaced by the calculator 31 of the second embodiment.

The first to the fourth embodiment are described using the block diagrams for explaining the function of the musical sound signal synthesizer. The block diagrams may be realized by an exclusive hard circuit, by a hard circuit such as a digital signal process circuit (DSP) which is partially versatile or by a soft processing like a program processing. In particular, in case this invention is applied to various kinds of electronic equipment having a computer circuit such as a game apparatus, a personal computer, a personal digital assistant and a telephone (a portable personal telephone), the function of the musical sound signal synthesizer may be realized by program processing a CPU of the computer circuit executes.

Other Modified Embodiments

In the first to the third embodiment, the sine wave table 13 is utilized as the waveform generator which generates waveform information representing a required waveform based on the input phase information.

Instead of the sine wave table 13, the absolute value transformer (triangle wave generator) 51 or a waveform memory which stores sampling values of a waveform similar to both a sine wave and a triangle wave may be utilized.

On the contrary, instead of the absolute value transformer (the triangle wave generator) 51 of the fourth embodiment, a sine wave table or a waveform memory which stores sampling values of a waveform similar to both a sine wave and a triangle wave may be utilized.

In the first to the fourth embodiment, the sine wave table 13 or the absolute value transformer 51 is used as the waveform generator for all the tone pitch frequencies of the musical sound signals to be generated.

However, the tone pitch frequencies of the musical sound signals to be generated may be divided into plural frequency bands to prepare plural waveform memories which store waveform data which are different according to each frequency band.

From the waveform memories, required waveform data may be selected and read out based on the tone pitch frequency of the musical sound signal to be generated.

According to this construction, an obstructive high frequency component is not fed back to the phase information ωt, so that a folded(inverted) noise generation due to the feedback of the obstructive high frequency component can be prevented.

In the first to the fourth embodiment, as the absolute value transformer 14, a transformer which transforms an input signal value into the absolute value which changes linearly is used.

However, instead of the linear transformer, a transformer which transforms an input signal value into the absolute value which changes nonlinearly may be used.

In the first to the fourth embodiment a singular musical sound signal synthesizer is shown.

However, plural musical sound signal synthesizers may be provided in parallel so that the output waveform information y or the phase information x to be generated by a different musical sound synthesizer may be fed back to the phase information ωt generated by the phase information generator 11.

As a result thereof, more complex and peculiar sound waveform signals can be generated.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A musical sound signal synthesizer comprising:

a waveform generator generating a waveform information representing a required waveform;

a nonlinear transformer transforming nonlinearly the generated waveform information generated by said waveform generator; and a calculator calculating a calculated phase information based on a phase of a musical sound signal to be generated and the waveform information nonlinearly transformed by said nonlinear transformer, and supplying said calculated phase information to said waveform generator, wherein said waveform generator generates said waveform information based on the calculated phase information.

2. The musical sound signal synthesizer as claimed in claim 1, wherein said waveform generator comprises a sine wave table storing a plurality of sampling values which represent a sine waveform.

3. The musical sound signal synthesizer as claimed in claim 1, wherein said nonlinear transformer comprises a polarity transformer for transforming said generated waveform information with a positive and a negative polarity into information with one polarity.

4. The musical sound signal synthesizer as claimed in claim 1, further comprising:

a low pass filter eliminating high frequency components from said nonlinearly transformed waveform information supplied from said nonlinear transformer to said calculator.

5. The musical sound signal synthesizer as claimed in claim 1, further comprising:

a gain controller controlling a gain of said nonlinearly transformed waveform information supplied from said nonlinear transformer to said calculator.

6. The musical sound signal synthesizer as claimed in claim 1, further comprising:

a limiter limitting a maximum value of said nonlinearly transformed waveform information supplied from said nonlinear transformer to said calculator.

7. The musical sound signal synthesizer as claimed in claim 6, wherein said limiter reduces a maximum value of said nonlinearly transformed waveform information supplied from said nonlinear transformer to said calculator, as a tone pitch frequency of a musical sound signal to be generated becomes higher.

8. The musical sound signal synthesizer as claimed in claim 1, further comprising:

a second calculator calculating a resultant value based on said waveform information nonlinearly transformed by said nonlinear transformer and the generated waveform information generated by said waveform generator, and supplying the resultant value to said calculator.

9. A musical sound signal synthesizer comprising:

a calculator supplying a calculated phase information;

a waveform generator generating waveform information representing a required waveform based on said calculated phase information supplied by said calculator; and a nonlinear transformer transforming nonlinearly said calculated phase information supplied by said calculator, wherein said calculator calculates said calculated phase information based on a phase of a musical sound signal to be generated and the transformed calculated phase information transformed by said nonlinear transformer.

10. The musical sound signal synthesizer as claimed in claims 9, wherein said waveform generator comprises a sine wave table storing a plurality of sampling values which represent a sine waveform.

11. The musical sound signal synthesizer as claimed in claim 9, wherein the nonlinear transformer comprises a polarity transformer for transforming said calculated phase information with a positive and a negative polarity into information with one polarity.

12. The musical sound signal synthesizer as claimed in claim 9, further comprising:

a low pass filter eliminating high frequency components from said nonlinearly transformed calculated phase information supplied from said nonlinear transformer to said calculator.

13. The musical sound signal synthesizer as claimed in claim 9, further comprising:

a gain controller controlling a gain of said nonlinearly transformed calculated phase information supplied from said nonlinear transformer to said calculator.

14. The musical sound signal synthesizer as claimed in claim 9, further comprising:

a limiter limiting a maximum value of said nonlinearly transformed calculated phase information supplied from said nonlinear transformer to said calculator.

15. The musical sound signal synthesizer as claimed in claim 14, wherein said limiter reduces a maximum value of said nonlinearly transformed phase information supplied from said nonlinear transformer to said calculator, as a tone pitch frequency of the musical sound signal to be generated becomes higher.

16. The musical sound signal synthesizer as claimed in claim 9, further comprising:

a second calculator calculating a resultant value based on the transformed calculated phase information nonlinearly transformed by said nonlinear transformer and said calculated phase information supplied by said calculator, and supplying the resultant value of said calculation to said calculator.

17. A method for synthesizing musical sound signals applied to a musical sound signal synthesizer having a waveform generator, said method comprising the steps of:

generating a waveform information representing a required waveform;

transforming nonlinearly said waveform information generated by said waveform generator; and calculating a calculated phase information based on a phase of a musical sound signal to be generated and said waveform information nonlinearly transformed, and supplying said calculated phase information to said waveform generator, wherein the waveform information is generated using the calculated phase information.

18. A method for synthesizing musical sound signals as claimed in claim 17, wherein said step of nonlinear transforming is a polarity transforming process for transforming said generated waveform information with a positive and a negative polarity into information with one polarity.

19. A method for synthesizing musical sound signals applied to a musical sound signal synthesizer having a waveform generator, said method comprising the steps of:

supplying a calculated phase information;

generating a waveform information representing a required waveform based on said calculated phase information;

transforming nonlinearly the calculated phase information, wherein the calculated phase information is calculated based on a phase of a musical sound to be generated and the transformed calculated phase information.

20. A method for synthesizing musical sound signal as claimed in claim 19, wherein said step of nonlinear transforming is a polarity transforming process for transforming said calculated phase information with a positive and a negative polarity into information with one polarity.

* * * * *